US005623739A

United States Patent [19]

Thompson

[11] Patent Number: 5,623,739

[45] Date of Patent: Apr. 29, 1997

[54] TODDLER/CHILD TOOTHBRUSH

[76] Inventor: Roxanne Thompson, #5 Starnes Addition, Springfield, Ill. 62702

[21] Appl. No.: 541,515

[22] Filed: Oct. 10, 1995

[51] Int. Cl.[6] ..... A46B 9/04

[52] U.S. Cl. ..... 15/167.1; 15/143.1; D4/104

[58] Field of Search ..... 15/167.1, 143.1; D4/104

[56] References Cited

U.S. PATENT DOCUMENTS

| | | | |
|---|---|---|---|
| D. 324,455 | 3/1992 | Fasitta et al. | D4/104 |
| 2,273,207 | 2/1942 | Kuhn | 15/167.1 |
| 2,360,745 | 10/1944 | Vogel | 15/167.1 |
| 3,753,266 | 8/1973 | Ceniceros | 15/110 |
| 4,654,921 | 4/1987 | Dinner | 15/143.1 |
| 5,048,143 | 9/1991 | Carroll | 15/167.1 |
| 5,052,071 | 10/1991 | Halm | 15/167.1 |
| 5,078,732 | 1/1992 | Ceniceros | 15/143.1 |
| 5,138,737 | 8/1992 | Thomas | 15/167.1 |
| 5,511,273 | 4/1996 | Carroll | 15/143.1 |

*Primary Examiner*—Timothy F. Simone
*Assistant Examiner*—James F. Hook

[57] ABSTRACT

A toothbrush consisting of a handle of plastics or rigid resin material and at one end thereof, a head with brushes, the handle forming a closed aperture in the approximate shape of a semi-circle curved on one side and straight on the other, sized to permit insertion of a small child's or toddler's four fingers thereby allowing fist gripping, the straight section of the handle being covered with a resilient material with small, soft protrusions to ensure secure gripping, the straight section extending without the resilient material covering and the soft protrusions beyond the closed aperture in a linear direction forming a bridge section from which a brush head angles at 25 degrees from the axis formed by the straight section of the toothbrush, the brush head having mounted thereon ample, soft, nylon bristles, the composition of which promotes dental hygiene when the toothbrush is used.

1 Claim, 1 Drawing Sheet

TODDLER/CHILD TOOTHBRUSH

BACKGROUND OF THE INVENTION

1. Field of the Invention

The present invention relates to toothbrushes in general, and more particularly, to toothbrushes sized and shaped for safe and effective usage by small children and toddlers.

2. Background Art

It is an established fact that plaque forms in the mouths of children as well as adults. Dental hygiene mandates brushing teeth on a consistent, preferably, daily basis. Currently marketed toothbrushes for toddlers and small children are formed to child proportions, constituting in essence, miniaturized versions of adult models, simply possessing smaller brush heads and straight albeit shorter, narrower handles than their adult counterparts. Such toothbrushes are problematic for toddlers and young children for two reasons: young children do not possess the manual dexterity to manipulate the toothbrush after insertion into the mouth to adequately brush all teeth, thereby promoting dental hygiene. Secondly, current models pose substantial safety risks insofar as the toothbrush can be facilely inserted beyond the teeth and gums into the throat, especially considering the natural proclivity of young children to insert objects into the mouth in an attempt to ingest them.

Several toothbrushes designed to facilitate handling by small children have been developed. U.S. Pat. No. 4,654,921 issued to Dinner manifests an infant toothbrush having a handle in the form of an oval ring with an array of bristles extending in alignment with the major axis of the ring. However, secure grasping of the toothbrush is negated due to the smooth texture of the oval ring. The toothbrush can shift with relative ease in the child's clenched fist when pressure is exerted for brushing purposes via the bristles coming in contact with the teeth. Moreover, the design of the toothbrush does not readily indicate which side of the oval to grasp. If the portion of the oval more distant from the major axis is secured, brushing of the lower teeth becomes difficult, at best.

U.S. Pat. No. 5,048,143 issued to Carroll demonstrates a combination chewing ring and toothbrush consisting of three rows of parallel bristles in a curved pattern at one end of the appliance and a teething ring at the other. Albeit the design enhances oral safety for a toddler or young child, the appliance does not promote brushing because of inherent design flaws, to wit, the appliance must be inverted for the bristles to effect brushing of the lower teeth, a difficult manipulation for especially young children. Furthermore, the curved configuration of the bristles and overall design of the apparatus inhibit brushing of all the teeth in the mouth. The apparatus fosters chewing in lieu of brushing.

U.S. Pat. No. 5,052,071 issued to Halm demonstrates a straight handled toothbrush with a grip portion, a resiliently flexible portion and an angular brush head. The shape of the toothbrush provides no safeguards for the safety of a toddler insofar as the toothbrush can be inserted with ease into the throat by the toddler due to the linear configuration of said toothbrush.

U.S. Pat. No. 5,138,737 issued to Thomas demonstrates a toothbrush with a closed handle triangular in shape bisected by a common center bar. The bristles are attached to the brush head of the toothbrush in one of two manners: the bristles protrude directly from the peripheral surface of the handle; or the bristles protrude from a stem which extends forwardly from the side or apex of the handle. Although the shape of both forms of this toothbrush, each of which is determined by the positioning of the bristles on the brush head, promotes safety by precluding insertion of the toothbrush into the child's throat, nevertheless, the bisecting common center bar of the handle does not facilitate easy gripping by the child insofar as one or more fingers can be inserted into one of the bisected apertures of the closed handle. If the fingers are not inserted so as to have two fingers in each of the bisected sections of the handle, grasping and brushing by the child is compromised. Furthermore, the toothbrush designed with the bristles protruding directly from the peripheral surface of the handle makes brushing of the child's molars virtually impossible.

U.S. Pat. No. 5,078,732 issued to Ceniceros demonstrates a teething ring with a simulated toothbrush. The configuration of the device promotes chewing and provides safety but inhibits brushing. The device is intended as preparatory in nature for conversion to use of a conventional toothbrush, the child, at the appropriate stage of development, being able to associate usage of a conventional toothbrush, with prior usage of this device.

SUMMARY OF THE INVENTION

The toothbrush for a toddler in this invention is comprised of a handle including an closed section in the approximate shape of a semi-circle through which the child inserts four fingers to allow gripping of the toothbrush. The straight portion of the semi-circular handle is covered with a resilient material with soft protrusions enabling secure grasping of the toothbrush by the child. The straight portion of the semi-circular handle extends, without the resilient material covering and the soft protrusions, beyond the closed semi-circle in a linear direction forming a bridge section from which the brush head angles at 25 degrees from the axis formed by the straight section of the toothbrush. The entire toothbrush thus far described is of unitary construction and made of rigid resin or plastics material of the type used in conventional toothbrushes. An array of upstanding nylon, soft, chiseled bristles for the purpose of brushing the teeth and promoting dental hygiene is affixed to the brush head.

The toothbrush for a toddler or small child in this invention has distinct advantages over previously designed toothbrushes, to wit: the semi-circular shape of the handle promotes gripping by the toddler allowing for insertion of four fingers, whilst simultaneously preventing dangerous insertion of the toothbrush into the throat; the straight portion of the semi-circular handle with the resilient material covering and the soft protrusions indicates the section of the toothbrush to hold and enables secure grasping of the handle by the toddler; the angular head of the toothbrush facilitates brushing; the chiseled nylon bristles affixed to the head of the toothbrush promote dental hygiene, enabling both cleaning of the teeth and massaging of the gums. No singularly previously designed toothbrush encompasses all of the aforementioned characteristics and advantages of the current toothbrush in this invention.

The above and other objects, advantages, and features of the present invention will become more readily appreciated for a consideration of the following detailed description of a preferred embodiment thereof, when taken together with the accompanying drawings, in which:

DETAILED DESCRIPTION OF THE PREFERRED EMBODIMENTS

Figure 1:
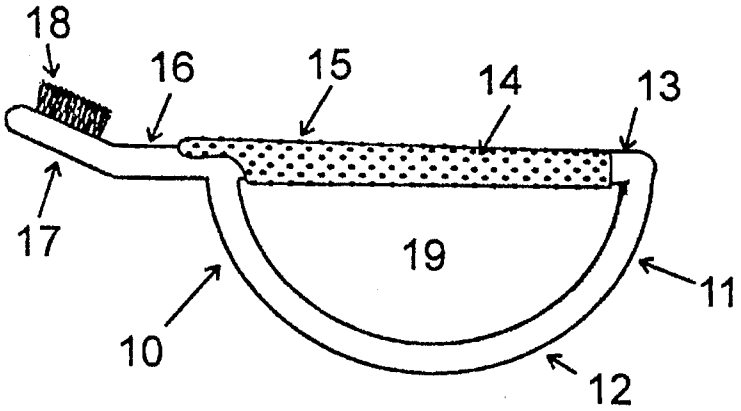
FIG. 1 is a side elevational view of a toothbrush in accordance with this invention.
Figure 2:
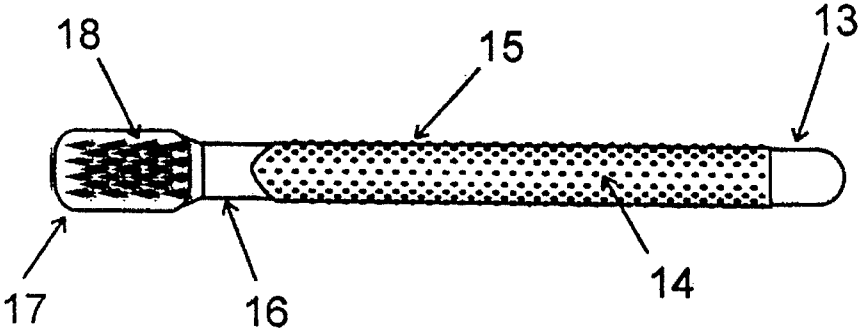
FIG. 2 is a top planned view of the toothbrush illustrated in FIG. 1.
Figure 3:
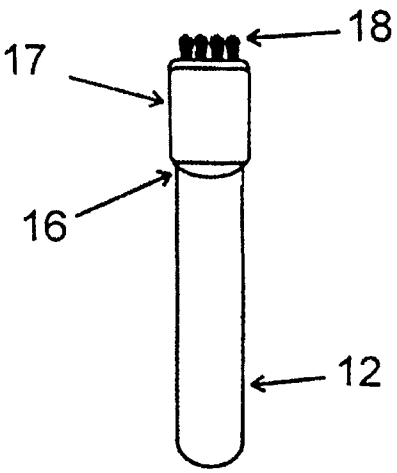
FIG. 3 is a front elevational view of the toothbrush illustrated in FIG. 1.
Figure 4:
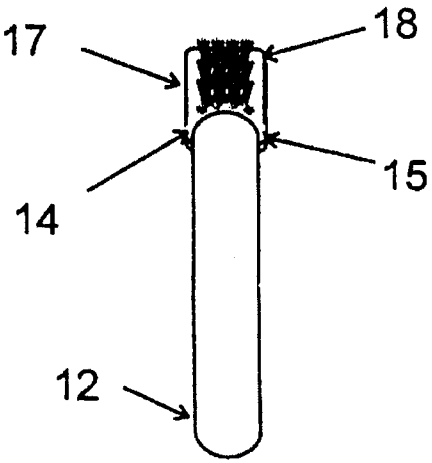
FIG. 4 is a back elevational view of the toothbrush illustrated in FIG. 1.

Referring more particularly to FIGS. 1–4 wherein like numbers refer to similar parts, the child's toothbrush subject of this invention is generally indicated as 10. The child's toothbrush 10 is preferably formed of injection molded plastic as a single unit comprising a handle and a brush head. The handle 11 is comprised of a circular portion 12 and a straight section 13 forming a closure in the shape of an approximate semi-circle for grasping by the child. The handle 11 is proportioned to the hand size of a small child to enable insertion of the four fingers. The straight section 13 of the handle is covered with a resilient material 14 with tiny, soft protrusions 15 to foster secure grasping of the toothbrush handle. The straight section 13 of the handle extends linearly beyond the closed semi-circular handle 11 forming a bridge piece 16 which is an integral part of the handle 11 and from which the brush head 17, also an integral part of the handle 11, continues at an angle of 25 degrees to the major axis of the handle 11 formed by the straight section 13. An array of soft, nylon, chiseled bristles 18 are affixed to the brush head 17 by embedding or anchoring the ends in accordance with well-known practice. The bristles 18 can be made of varying stiffness and length ranging from very soft to firmer bristles and from shorter to longer bristles dependent upon the age of the child and maturation of the teeth. The dimensions of the toothbrush 10 are proportioned to permit a young child to hold the closed semi-circular handle 11 within the grip of the child's fist, by passing the child's four fingers through the aperture 19 defined by the semi-circular handle 11, and securely grasping the straight section 13 of the semi-circular handle 11. All edges of the child's toothbrush 10 are rounded to preclude injury to the oral cavity and anatomy thereof.

It is understood that the invention is not confined to the particular construction and arrangement of parts herein illustrated and described, but includes such modified forms thereof as come within the scope of the following claims.

I claim:

1. A toothbrush for a toddler or young child comprising:

a handle of unitary rigid construction having a straight section having a longitudinal axis and a curved section thereby defining a closed semi-circular ring, whereby the curved section prevents mouth injury by limiting insertion of the handle into a young child's mouth;

a bridge member extending linearly from and along the longitudinal axis of the straight section of the handle;

a brush head extending at an angle of 25 degrees from the longitudinal axis of the straight section and in a direction opposite to the curved section of the handle, said semi-circular closed ring defining an aperture sized to be proportional with and to receive four fingers of the young child;

the straight section of the handle being uniformly covered with a resilient material and provided with soft protrusions to enable secure gripping of the handle; and the brush head including an array of soft, chiseled, nylon bristles attached to said brush head.

* * * * *